US006268031B1

(12) United States Patent
Bleibler

(10) Patent No.: US 6,268,031 B1
(45) Date of Patent: Jul. 31, 2001

(54) INJECTION HOSE AND METHOD OF PRODUCING IT

(75) Inventor: Alexander Bleibler, Winterthur (CH)

(73) Assignee: Sika AG, vormals Kaspar Winkler & Co. (DE)

( * ) Notice: Subject to any disclaimer, the term of this patent is extended or adjusted under 35 U.S.C. 154(b) by 0 days.

(21) Appl. No.: 09/202,966

(22) PCT Filed: Jun. 21, 1997

(86) PCT No.: PCT/EP97/03261

§ 371 Date: Dec. 23, 1998

§ 102(e) Date: Dec. 23, 1998

(87) PCT Pub. No.: WO97/49876

PCT Pub. Date: Dec. 31, 1997

(30) Foreign Application Priority Data

Jun. 25, 1996 (DE) ..... 196 25 209

(51) Int. Cl.[7] ..... F16J 15/00; F16J 15/02

(52) U.S. Cl. ..... 428/36.8; 428/36.9; 428/36.91; 138/177; 138/178; 277/630; 277/645; 277/649; 277/906; 156/244.15; 156/244.13; 264/209.3; 264/209.6

(58) Field of Search ..... 277/630, 644, 277/645, 649, 906; 138/120, 155, 177, 178; 428/36.8, 36.9, 36.91; 156/244.14, 244.13, 244.15; 264/209.1, 209.3, 209.6

(56) References Cited

U.S. PATENT DOCUMENTS 4,722,479 * 2/1988 Koob ..... 239/145
4,802,938 * 2/1989 Kitami et al. ..... 156/149

OTHER PUBLICATIONS

Lewis, Richard J., Hawley's Condensed Chemical Dictionary, Thirteenth Edition, John Wiley and Sons, Inc., p. 205, 1997.*

* cited by examiner

*Primary Examiner*—Rena L. Dye
(74) *Attorney, Agent, or Firm*—Pendorf & Cutliff

(57) ABSTRACT

An injection hose intended for sealing expansion joint in concrete structures. The hose is in the form a continuous hollow extrusion (12), made of elastic, flexible material, with a continuous longitudinal bore (10) and at least one longitudinal groove (16). The groove (16) is connected to the bore (10) by means of apertures (22) in the wall of the extrusion and is fitted with a sealing strip (24), made of compressible, elastic material, which extends over the apertures (22). Production of the hose is made particularly simple and inexpensive by virtue of the fact that the width of the groove openings (26) is less than the diameter of the sealing strip (24) and that the means of holding the sealing strip (24) in place are formed by making undercuts in the side (30) of the groove (16).

15 Claims, 2 Drawing Sheets

INJECTION HOSE AND METHOD OF PRODUCING IT

BACKGROUND OF THE INVENTION

1. Field of the Invention

The invention is related to an injection hose having a continuous hollow extrusion made of elastically resilient material, comprising a continuous longitudinal conduit and at least one continuous longitudinal groove which communicates with the longitudinal conduit through apertures in the bottom of the groove and which is delimited by lateral groove sides and is open at a groove opening, and comprising a sealing string made of rubber-elastically flexible, preferably compressible, material, one each of which is disposed in the at least one longitudinal groove, which is held in the groove by retaining means, and which extends over the apertures. The invention is further related to a method for the production of such an injection hose.

2. Description of the Related Art

Injection hoses of this type are predominantly used to permanently seal construction joints and expansion joints of structures, in particular of concrete structures. To this end the injection hose, which is inserted into the joint when the concrete is poured, is subjected by way of the longitudinal conduit to a pressurized hardenable liquid or pasty sealant in such a manner that the sealant is injected into the joint through the apertures while the sealing string is lifted off from the apertures. An injection hose of this type is known (EP-A-0 522 327), in which the retaining means for sealing strings loosely inserted into the longitudinal grooves are formed by a stocking which is drawn over the profile extrusion and which is made of a thin material which is permeable to liquid or which disintegrates under the influence of the injection liquid. The drawing of the retaining stocking over the loosely inserted sealing strings and the fixation of the retaining stocking at the end of a length of the profile extrusion has proven to cause considerable production difficulties, which increases the cost of the product. This disadvantage is most noticable when the profile extrusion has a non-circular cross section. Further, the handling of the profile extrusion covered with the retaining stocking is awkward in practice.

SUMMARY OF THE INVENTION

Based on this it is the object of the invention to develop an injection hose of the type described above as well as a method for its production, with which the production is simplified without resulting in functional disadvantages and the handling of the injection hose is improved.

The solution according to the invention is based on the thought that it is possible to do without the retaining stocking altogether without functional disadvantages when the profile extrusion is suitably designed. In order to achieve this, it is proposed according to the invention that the opening width of the groove opening is smaller than the diameter of the sealing string in its relaxed state, and that the retaining means are formed by undercuts in the groove sides of the longitudinal groove. With these measures it is attained that the sealing string is clamped sufficiently securely within the longitudinal groove due to its elasticity, so that it is not lost when the injection hose is wound onto a transport roll, when it is removed from the transport roll, and when it is handled. The sealing string seals off the longitudinal conduit from external moisture, while it opens an output gap for the sealant when the longitudinal conduit is subjected to pressurized liquid sealant, without itself being forced out of the longitudinal groove. By this it is also ensured that the output gap is automatically closed after the injection process is completed, so that the longitudinal conduit can be evacuated without moisture entering from the outside.

According to a preferred embodiment of the invention it is provided that the diameter of the sealing string is larger than the depth of the longitudinal groove, so that a portion of the sealing string inserted into the longitudinal groove protrudes radially over the groove opening while being constricted by the edge of the groove. Advantageously, the groove sides are to this end curved in profile in a hook-like manner toward the inside of the groove in the region of their opening-side edges. In principle it is also possible that the groove sides are to this end formed as dovetailed undercuts.

A further preferred embodiment of the invention provides for at least one further longitudinal groove which is closed with respect to the longitudinal conduit, is undercut at its sides, and is outwardly open, in which groove there is disposed in a form-fitting manner an elastically resilient, flexible sealing strip which is made of a material which swells when absorbing water. With such sealing strips it is achieved that when water enters a joint the sealing strip swells out from the corresponding groove and seals the joint from water breakthrough.

The profile extrusion expediently has a multi-sided, preferably triangular profile, at the profile corners of which are disposed the longitudinal grooves which are provided with the wall apertures and are fitted with the sealing strings, the longitudinal conduit being disposed centered within the profile extrusion. In this embodiment the longitudinal grooves which are closed toward the longitudinal conduit and are fitted with the swelling sealing strips are expediently disposed in the sides of the profile extrusion.

While the profile extrusion is expediently made of a caoutchouc, preferably of EPDM-caoutchouc, the sealing strings are expediently made of compressible sponge rubber. The sealing strips which swell up under the influence of water may consist of rubber with swellable additives such as urethane resin, polyvinyl alcohol or acrylic resin.

For the production of the injection hoses the method according to the invention provides that the profile extrusion consisting of caoutchouc is extruded over a mandrel, which creates the longitudinal conduit, while fashioning the undercut longitudinal grooves and is subsequently vulcanized and cooled, that before or during the vulcanization process spaced apertures are pressed, under displacement of material, into at least part of the longitudinal grooves of the profile extrusion which is transported over the mandrel. Then sealing strings and/or sealing strips are continuously supplied from the side to the profile extrusion which has been pulled off from the mandrel and cooled off and are pressed or rolled into the corresponding longitudinal grooves. The flexible profile extrusion prepared in this manner is then wound onto transport rolls in portions and cut to length.

BRIEF DESCRIPTION OF THE DRAWINGS

In the following the invention is further described with reference to the drawing, in which.

DETAILED DESCRIPTION OF THE INVENTION

Figure 1:
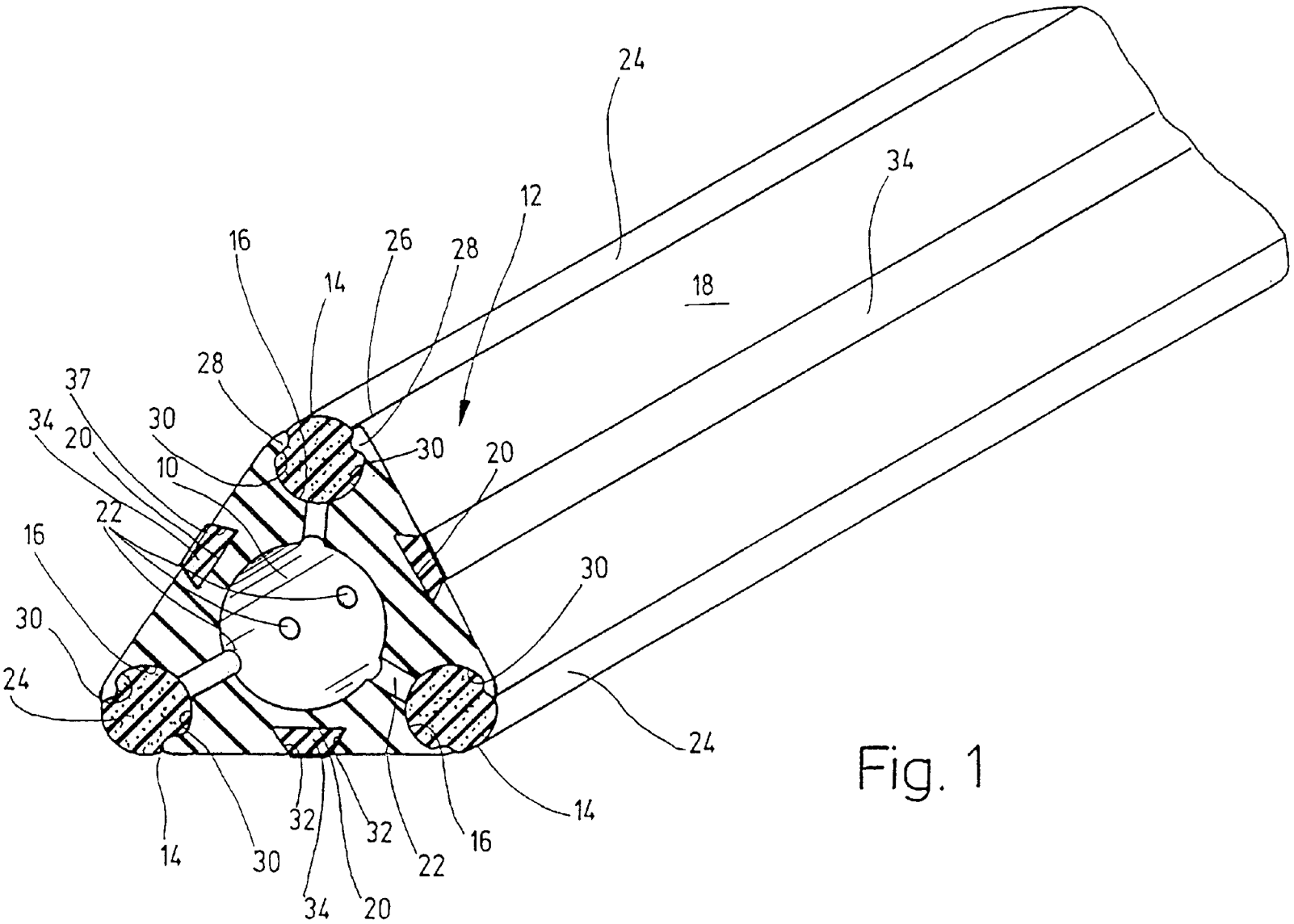
FIG. 1 shows a partially cut perspective view of an injection hose.

The injection hose shown in the drawing is intended for sealing construction joints and expansion joints in concrete structures. It comprises a profile extrusion 12 having an essentially triangular cross section and a central longitudinal conduit 10, which extrusion is provided with longitudinal grooves 16 in the region of its corners 14 and with longitudinal grooves 20 in the region of its side surfaces 18. The longitudinal grooves 16 communicate with the longitudinal conduit 10 by way of apertures 22 at the bottom of the groove which are disposed spaced with respect to each other, and are fitted with sealing strings 24 made of a rubber-elastic, pliable, and compressible material, such as foam rubber. The width of the groove openings 26 is smaller than the diameter of the sealing strings 24. Since the depth of the grooves is also smaller than the diameter of the sealing strings 24, the sealing strings 24 protrude outwards through the groove openings 26 and are constricted in the region of the opening gap by the inwardly curved edges 28 of the groove sides 30, as shown in FIG. 1. The sealing strings 24 extend over the apertures 22 within the longitudinal grooves 16 and thereby seal off the longitudinal conduit from external moisture. If, on the other hand, the longitudinal conduit 10 is subjected to a pressurized injection fluid, the pliable sealing strings 24 expose gaps through which the injection fluid may flow outwards, without the strings being forced out of their longitudinal groove 16. Possible hardenable injection fluids include, for example, water miscible, reactively hardening resins, resins on the basis of vinyl esthers, polyurethane resins, fine cement, epoxy resins, and the like.

The longitudinal grooves 20 in the sides 18 of the profile extrusion 12 are closed toward the longitudinal conduit 10 at their bottom. They have dovetailed undercut groove sides 32 and hold a sealing strip 34 which swells under the influence of water and which is anchored in the groove in a form-fitting manner. When exposed to water, the sealing strip may, by a suitable choice of material, swell to a multiple of its volume and seal off from water passage a gap formed between the profile extrusion 12 and an adjacent concrete surface.

Figure 2:
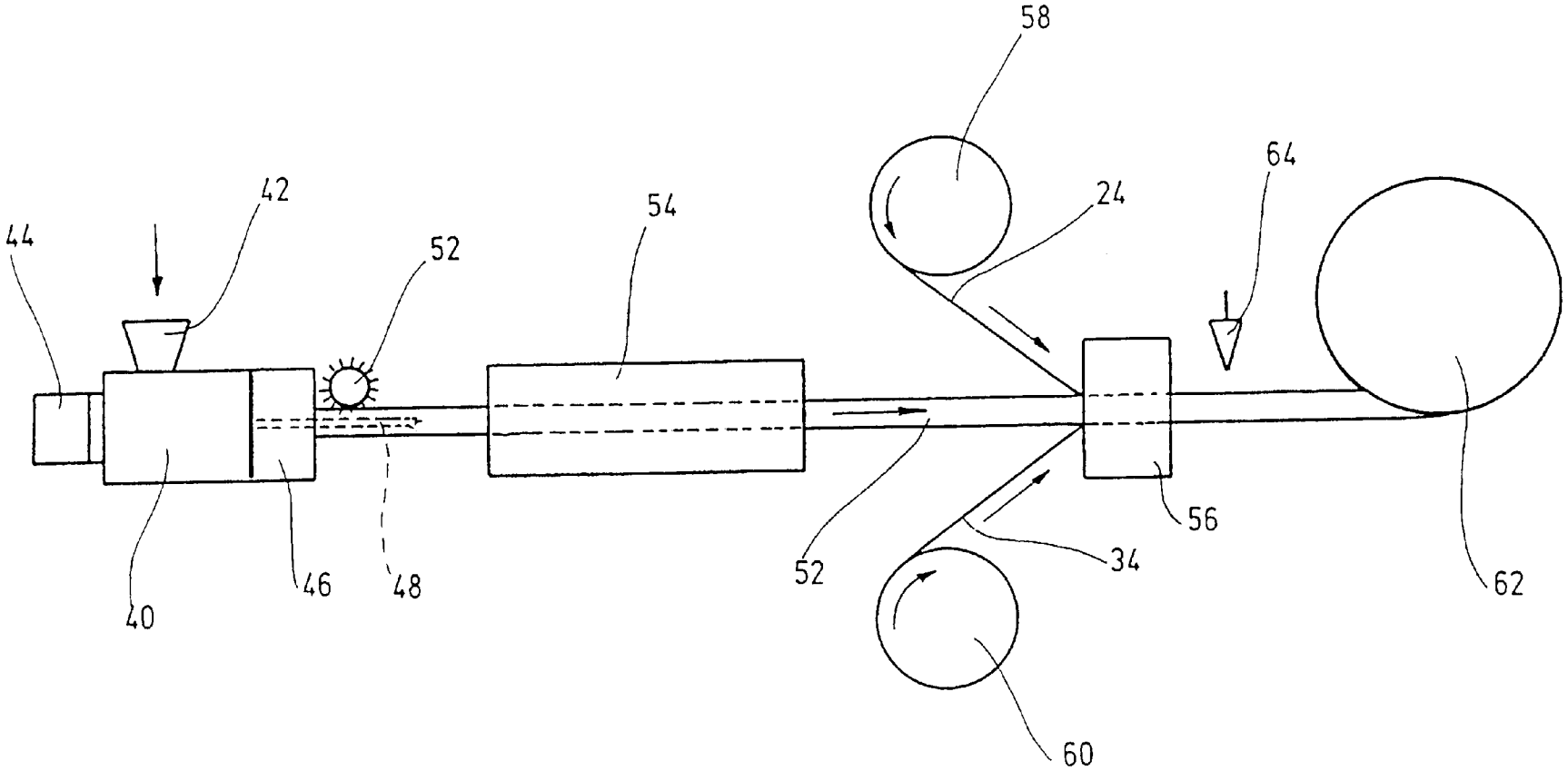
FIG. 2 shows a schematic of the process of the production of the injection hose of FIG. 1.

From the function schematic of FIG. 2 is can be seen that the plastic material for the production of the profile extrusion 12 is supplied to an extruder 40 by way of the inlet 42 and is pressed, with the aid of a drive mechanism 44, over a mandrel 48 by a shaping tool 46. The metallic mandrel 48 serves to form the longitudinal conduit 10 of the profile extrusion and further serves as an abutment for the knobbed roller 52, with which the apertures 22 in the region of the longitudinal grooves 16 are formed into the extrusion material while this is still soft. In the vulcanizing and cooling station 54, which, depending on the extrusion speed, may be a multiple of ten meters long, the profile extrusion is hardened. In a packing station 56 the sealing strings 24 and sealing strips 34, which are taken from supply rolls 58, 60, are continuously fed to the profile extrusion 12 and rolled into the corresponding longitudinal grooves 16, 20. The profile extrusion 12 prepared in this manner is then wound onto transport rolls 62 in portions and cut to the desired length in the cutting station 64.

In summary the following is to be stated: The invention is related to an injection hose intended for sealing construction joints and expansion joints in concrete structures. The injection hose comprises a profile extrusion 12 made of elastic flexible material, which has a continuous longitudinal conduit 10 and at least one longitudinal groove 16. The longitudinal groove communicates with the longitudinal conduit by way of apertures in the bottom of the groove and is fitted with a sealing string 24 which extends over the apertures and which is made of rubber-elastically pliable, compressible material. Production of the injection hose is made especially simple and inexpensive by virtue of the fact that the width of the groove openings 26 is smaller than the diameter of the sealing string 24, and that the retaining means for holding the sealing string are formed by undercuts in the groove sides 30 of the longitudinal groove.

What is claimed is:

1. An injection hose comprising a longitudinally extending continuous hollow structure (12) made of an elastically resilient material, and comprising:

(a) a continuous longitudinal passage (10) having:
a central hollow longitudinally extending passage,
an outer surface, and
at least one continuous longitudinal groove (16) extending inwardly from said outer surface to a depth (d), and having a groove opening (26) at the outer surface, a groove bottom, lateral groove sides (30), and apertures (22) extending between the central hollow longitudinally extending passage and the groove bottom, and (b) at least one sealing strip (24) made of a rubber-elastic flexible material, disposed in said at least one longitudinal groove (16), which sealing strip covers over the apertures (22), wherein the opening width of the groove opening (26) is smaller than the diameter of the sealing strip (24) in its relaxed state, and wherein the sealing strip is held in the groove by retaining means (28), said retaining means comprising undercuts in the groove sides (30) of the longitudinal groove (16).

2. The injection hose of claim 1, wherein the diameter of the sealing strip (24) is larger than the depth (d) of the longitudinal groove (16).

3. The injection hose of claim 1, wherein the groove sides (30) include inwardly protecting profiles along the region of the groove opening-side edges (28).

4. The injection hose of claim 1, wherein said hose is provided with at least one further longitudinal groove (20) which is not in communication with the longitudinal passage (10), which further groove is undercut at its sides (32) and is outwardly open, in which groove there is disposed in a form-fitting manner an elastically resilient, flexible sealing strip (34) which is made of a material which swells when absorbing water.

5. The injection hose of claim 4, wherein the sealing strips consist of rubber with swellable additives.

6. The injection hose of claim 1, wherein the groove sides (30) have dove-tailed undercuts.

7. The injection hose of claim 1, wherein the injection hose extrusion (12) has a multi-sided profile, at the profile corners (14) of which are disposed said longitudinally extending grooves (16) which are in communication with said longitudinal passage (10) provided with the apertures (22) and are fitted with the sealing strips (24).

8. The injection hose of claim 7, wherein the longitudinal passage (10) is disposed centered within the injection hose extrusion (12).

9. The injection hose of claim 7, wherein said injection hose is provided with additional longitudinal grooves, which additional grooves are not in communication with the longitudinal passage (10), are fitted with elastically resilient, flexible sealing strips (34) made of a material which swells when absorbing water, and which additional grooves are disposed in the flat sides of the injection hose extrusion (12).

10. The injection hose of claim 7, wherein the extrusion (12) has a triangular profile.

11. The injection hose of claim 1, wherein the injection hose extrusion is made of a caoutchouc.

12. The injection hose of claim 1, wherein the sealing strips (24) are made of sponge rubber.

13. The injection hose of claim 1, wherein said at least one sealing strip (24) is made of a compressible rubber-elastic flexible material.

14. The injection hose of claim 1, wherein the profile extrusion is made of EPDM-caoutchouc.

15. A method for producing an injection hose comprising a longitudinally extending continuous hollow structure (12) made of an elastically resilient material, and comprising:

(a) a continuous longitudinal passage (10) having:
a central hollow longitudinally extending passage,
an outer surface, and
at least one continuous longitudinal groove (16) extending inwardly from said outer surface to a depth (d), and having a groove opening (26) at the outer surface, a groove bottom, lateral groove sides (30), and apertures (22) extending between the central hollow longitudinally extending passage and the groove bottom, and (b) at least one sealing strip (24) made of a rubber-elastic flexible material, disposed in said at least one longitudinal groove (16), which sealing strip covers over the apertures (22), wherein the opening width of the groove opening (26) is smaller than the diameter of the sealing strip (24) in its relaxed state, and wherein the sealing strip is held in the groove by retaining means (28), said retaining means comprising undercuts in the groove sides (30) of the longitudinal groove (16), the method comprising extruding a profile extrusion (12) consisting of caoutchouc over a mandrel (48), which creates the longitudinal passage (10), while fashioning the undercut longitudinal grooves (16, 20) such that said extrusion is substantially vulcanized and cooled, pressing spaced apertures before or during the vulcanization process, under displacement of material, into at least part of the longitudinal grooves (16) of the profile extrusion (120) which is transported over the mandrel (48), continuously supplying sealing strips (34) from the side to the profile extrusion (12) which has been pulled off from the mandrel (48) and cooled off and pressing or rolling this into the corresponding longitudinal grooves (16, 20), and winding the flexible profile extrusion (12) prepared in this manner onto transport rolls (62) in portions and cut to length.

* * * * *